US011080954B1

(12) United States Patent
Rogers et al.

(10) Patent No.: US 11,080,954 B1
(45) **Date of Patent: *Aug. 3, 2021**

(54) AUTOMATIC EMERGENCY DOOR UNLOCK SYSTEM

(71) Applicant: Alarm.com Incorporated, Tysons, VA (US)

(72) Inventors: Thomas Rogers, Frederick, MD (US); David James Hutz, Herndon, VA (US); Noah Robert Weingart, Arlington, VA (US)

(73) Assignee: Alarm.com Incorporated, Tysons, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/895,030

(22) Filed: Jun. 8, 2020

Related U.S. Application Data

(63) Continuation of application No. 16/106,489, filed on Aug. 21, 2018, now Pat. No. 10,679,442, which is a continuation of application No. 15/654,967, filed on Jul. 20, 2017, now Pat. No. 10,062,233.

(60) Provisional application No. 62/364,557, filed on Jul. 20, 2016.

(51) Int. Cl.

| | |
|---|---|
| ***G07C 9/00*** | (2020.01) |
| ***G08B 27/00*** | (2006.01) |
| ***G07C 9/38*** | (2020.01) |

(52) U.S. Cl.

CPC ..... *G07C 9/00309* (2013.01); *G07C 9/00174* (2013.01); *G07C 9/00571* (2013.01); *G07C 9/00896* (2013.01); *G07C 9/38* (2020.01); *G08B 27/001* (2013.01); *G07C 2009/00333* (2013.01); *G07C 2009/00769* (2013.01)

(58) Field of Classification Search

CPC ..... G07C 9/00309; G07C 9/00174; G07C 9/00571; G07C 9/0896; G07C 9/00166; G07C 9/00333; G07C 2009/00769; G07C 9/38; G08B 27/001

See application file for complete search history.

(56) References Cited

U.S. PATENT DOCUMENTS

| | | | | |
|---|---|---|---|---|
| 10,062,233 | B1 | 8/2018 | Rogers et al. | |
| 10,679,442 | B1 | 6/2020 | Rogers et al. | |
| 2002/0180582 | A1 | 12/2002 | Nielsen | |
| 2011/0241877 | A1 * | 10/2011 | Wedig | G08B 25/016 340/540 |

(Continued)

FOREIGN PATENT DOCUMENTS

| | | | |
|---|---|---|---|
| JP | 2014-71810 | 4/2014 | |
| JP | 2014-71810 A * | 4/2014 | G08B 27/00 |

*Primary Examiner* — Brian Wilson

(74) *Attorney, Agent, or Firm* — Fish & Richardson P.C.

(57) ABSTRACT

In some implementations, systems and techniques are described to automatically unlock a front door of a property in response to detecting an alarm signal indicating an emergency at or near a property. Data indicating occurrence of an emergency condition at a property is initially obtained. A lock configuration for an electronic lock of the property is determined. An unlock instruction is generated for the electronic lock based on the determined lock configuration for the electronic lock. The unlock instruction is transmitted to the electronic lock such that, when the unlock instruction is received by the electronic lock, the electronic lock is unlocked according to the unlock instruction.

20 Claims, 7 Drawing Sheets

(56) References Cited

U.S. PATENT DOCUMENTS

2015/0109104 A1* 4/2015 Fadell ..... H04L 67/12
340/5.65

* cited by examiner

AUTOMATIC EMERGENCY DOOR UNLOCK SYSTEM

CROSS-REFERENCE TO RELATED APPLICATIONS

This application is a continuation of U.S. application Ser. No. 16/106,489, filed Aug. 21, 2018, now allowed, which is a continuation of U.S. application Ser. No. 15/654,967, filed Jul. 20, 2017, now U.S. Pat. No. 10,062,233, issued Aug. 28, 2018, which claims the benefit of U.S. Provisional Application No. 62/364,557, filed Jul. 20, 2016, and titled "Automatic Emergency Door Unlock System." All of these applications are incorporated by reference in their entirety.

TECHNICAL FIELD

This disclosure application relates generally to monitoring systems and, for example, portable safety monitoring.

BACKGROUND

Personal emergency response systems (PERS) are systems that are designed to signal an emergency requiring urgent attention and to request the assistance of emergency responders. Such systems often include a wireless pendant or transmitter that can be activated by a user in an emergency. When the pendant is activated, an alarm signal is transmitted to a central station of an alarm monitoring company or an emergency responder.

SUMMARY

Techniques are described for automatically unlocking a front door of a property during an emergency response situation. Users of emergency response systems may be reluctant to request emergency responders as they may be worried about property damage. For example, if fire fighters arrive at a locked property, the fire fighters may break down a front door of the locked property. Repair or replacement of damaged property may be costly, and this cost may discourage users from requesting emergency responders. For example, a user that is suffering from a heart attack may not request for emergency response until their chest pain is unbearable. The delay or avoidance of requesting emergency responders may result in harm to the users. A system that enables users to unlock a front door during an emergency response situation may encourage users to request for emergency response by reducing concerns regarding property damage costs resulting from the emergency response.

The techniques described throughout also enable users to more easily exit a property during an emergency condition. For example, in response to detecting a fire condition at a property, the system automatically unlocks all doors and windows within the property so that a user that is attempting to exit the property can have multiple different exit routes. In this regard, system can allow for faster egress out of a property during an emergency condition by disabling locked doors or windows, which may impede exit routes of the property.

Implementations of the described techniques may include hardware, a method or process implemented at least partially in hardware, or a computer-readable storage medium encoded with executable instructions that, when executed by a processor, perform operations.

The details of one or more implementations are set forth in the accompanying drawings and the description below.

Other features will be apparent from the description and drawings, and from the claims.

DESCRIPTION OF DRAWINGS

In the drawings, like reference numbers represent corresponding parts throughout.

DETAILED DESCRIPTION

In general, techniques are described to automatically unlock a front door of a property in response to detecting an alarm signal indicating an emergency at or near a property. For instance, a user inside the property may initially use an electronic device worn by the user or affixed to the property to indicate an emergency condition such as a fire or a medical emergency inside a property. In response to determining that the user has indicated the emergency condition, a system may (i) transmit an emergency signal to emergency responders so that emergency responders will come to the property and (ii) identify a locking mechanism associated with the front door of the property and automatically transmit an instruction to the identified locking mechanism to unlock the front door. The transmission of the unlock instruction allows emergency responders to enter the property without forcible entry even when the user is unable to manually unlock the front door. In addition, the door unlock instruction may further specify a time period for which the door remains unlocks so that the front door can automatically be locked after responders have left the property. Thus, the techniques described throughout prevent damage to the property while also maintaining security of the property and wellbeing of users. While the front door is described as being unlocked, other doors or windows may be additionally or alternatively automatically be unlocked or opened by the system.

Figure 1:
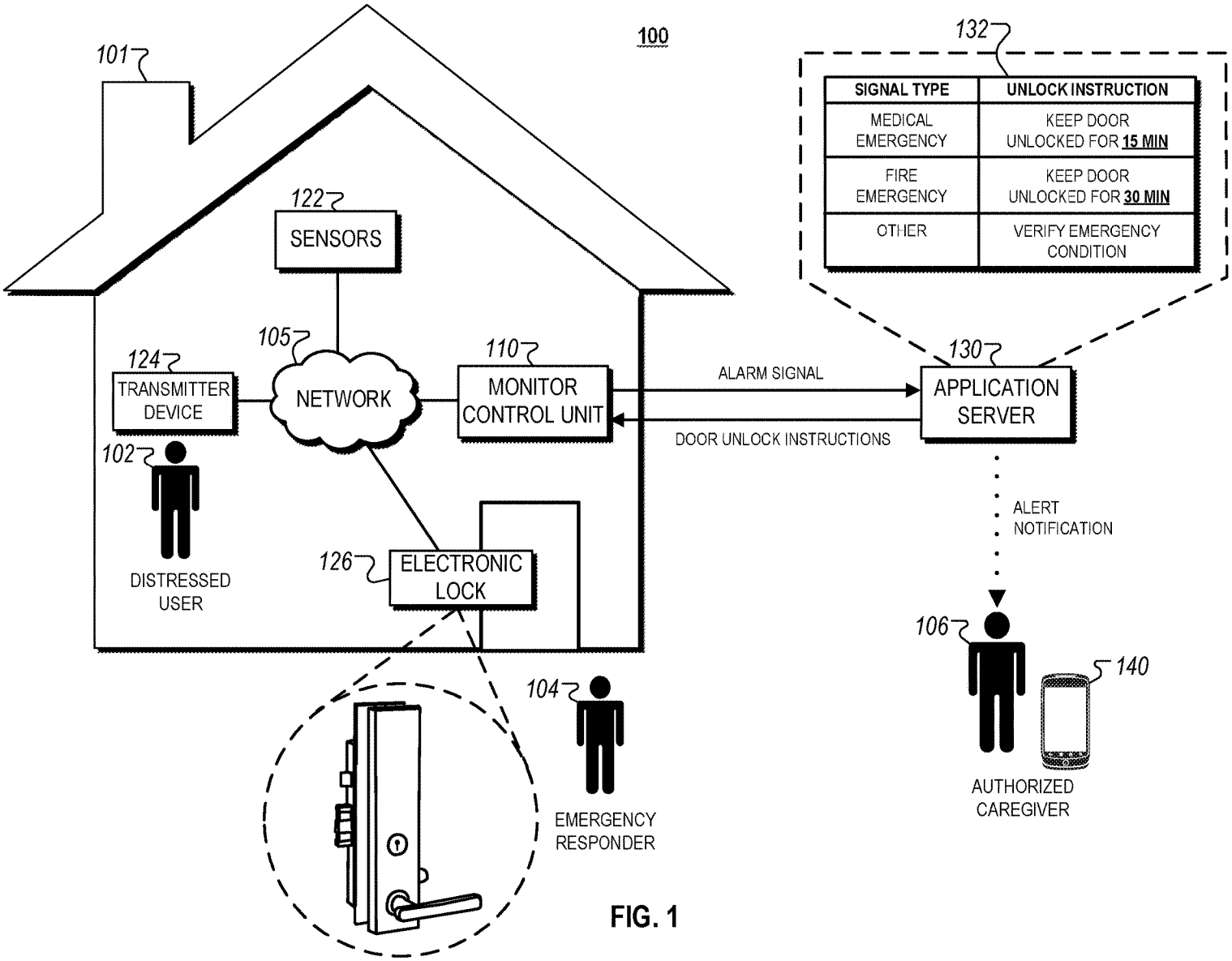
FIG. 1 is a schematic diagram that illustrates an example of a system that automatically unlocks a front door of a property in response to an emergency signal.

FIG. 1 illustrates an example of a system 100 that automatically unlocks a front door of a property 101. The system 100 may include a monitor control unit 110, sensors 122, a transmitter device 124, an electronic lock 126, and an application server 130, connected over a network 105. The network 105 enables the components of the system 100 to exchange data communications related to an alarm signal transmitted from the alarm device and by a user 102.

In general, the system 100 enables the automatic transmission of a door unlock instruction such that the electronic lock 126 is unlocked in response to an alarm signal. The user 102 may initially indicate the presence of an emergency condition within the property 101 using the transmitter device 124, and in response, an alarm signal may be generated by the monitor control unit 110 and transmitted through the network 105 to the application server 130. The application server 130 then notifies emergency responders of the emergency and identifies and selects an appropriate unlock instruction based on the received alarm signal, and then transmits the selected unlock instruction to the monitor control unit 110. The unlock instruction is then relayed by the monitor control unit 110 to automatically unlock the electronic lock 126. As described in more detail below, the selected unlock instruction may specify a time period with which the electronic lock 126 may remain unlocked, and/or a particular unlock mechanism based on attributes associated with the electronic lock 126. Additionally or alternatively, as described below, the monitor control unit 110 may determine an emergency is occurring within the property 101, whether in response to an indication provided by a user, e.g., a user pressing a panic button, or monitoring the property 101, e.g., sensing smoke indicating a fire, and, in response and without further input from the user after the monitor control unit 110 determines the emergency is occurring, notify emergency responders and instruct the electronic lock 126 to unlock.

Referring now to the components of the system 100, the network 105 is configured to enable exchange of electronic communications between devices connected to the network 105. For example, the network 105 may be configured to enable exchange of electronic communications between the monitor control unit 110, the sensors 122, the transmitter device 124, the electronic lock 126 and the application server 130. The network 105 may include, for example, one or more of the Internet, Wide Area Networks (WANs), Local Area Networks (LANs), analog or digital wired and wireless telephone networks (e.g., a public switched telephone network (PSTN), Integrated Services Digital Network (ISDN), a cellular network, and Digital Subscriber Line (DSL)), radio, television, cable, satellite, or any other delivery or tunneling mechanism for carrying data. The network 105 may include multiple networks or subnetworks, each of which may include, for example, a wired or wireless data pathway.

The network 105 may also include a circuit-switched network, a packet-switched data network, or any other network able to carry electronic communications (e.g., data or voice communications). For example, the network 105 may include networks based on the Internet protocol (IP), asynchronous transfer mode (ATM), the PSTN, packet-switched networks based on IP, X.25, or Frame Relay, or other comparable technologies and may support voice using, for example, VoIP, or other comparable protocols used for voice communications. The network 105 may include one or more networks that include wireless data channels and wireless voice channels. The network 105 may be a wireless network, a broadband network, or a combination of networks including a wireless network and a broadband network.

The monitor control unit 110 may be an electronic device that coordinates and/or monitors the operations of the components of the system 100 through a set of data transmissions with each of the components of the system 100. The monitor control unit 110 includes a controller and a network module. The controller is configured to control the system 100 (e.g., a home alarm or security system) that includes the monitor control unit 110. In some examples, the controller may include a processor or other control circuitry configured to execute instructions of a program that controls operation of an alarm system. In these examples, the controller may be configured to receive input from sensors, detectors, or other devices included in the alarm system and control operations of devices included in the alarm system or other household devices (e.g., a thermostat, an appliance, lights, etc.). For example, the controller may be configured to control operation of the network module included in the monitor control unit 110.

The network module is a communication device configured to exchange communications over the network 105. The network module may be a wireless communication module configured to exchange wireless communications over the network 105. For example, the network module may be a wireless communication device configured to exchange communications over a wireless data channel and a wireless voice channel. In this example, the network module may transmit alarm data over a wireless data channel and establish a two-way voice communication session over a wireless voice channel. The wireless communication device may include one or more of a LTE module, a GSM module, a radio modem, cellular transmission module, or any type of module configured to exchange communications in one of the following formats: LTE, GSM or GPRS, CDMA, EDGE or EGPRS, EV-DO or EVDO, UMTS, or IP.

The network module may also be a wired communication module configured to exchange communications over the network 105 using a wired connection. For instance, the network module may be a modem, a network interface card, or another type of network interface device. The network module may be an Ethernet network card configured to enable the monitor control unit 110 to communicate over a local area network and/or the Internet. The network module also may be a voice-band modem configured to enable the alarm panel to communicate over the telephone lines of Plain Old Telephone Systems (POTS).

The monitor control unit 110 also may include a communication module that enables the monitor control unit 110 to communicate other devices of the system 100. The communication module may be a wireless communication module that allows the monitor control unit 110 to communicate wirelessly. For instance, the communication module may be a Wi-Fi module that enables the monitor control unit 110 to communicate over a local wireless network at the property 101. The communication module further may be a 900 MHz wireless communication module that enables the monitor control unit 110 to communicate directly with a monitor control unit. Other types of short-range wireless communication protocols, such as Bluetooth, Bluetooth LE, Zwave, ZigBee, etc., may be used to allow the monitor control unit 110 to communicate with other devices in the property 101.

In some examples, the monitor control unit 110 may include data capture and recording devices. In these examples, the monitor control unit 110 may include one or more motion sensors, one or more microphones, one or more biometric data collection tools, one or more temperature sensors, one or more humidity sensors, one or more air flow sensors, and/or any other types of sensors that may be useful in capturing monitoring data related to the property 101 and users in the property.

The monitor control unit 110 further may include processor and storage capabilities. The monitor control unit 110 may include any suitable processing devices that enable the monitor control unit 110 to operate applications and perform the actions described throughout this disclosure. In addition, the monitor control unit 110 may include solid state electronic storage that enables the monitor control unit 110 to store applications, configuration data, collected sensor data, and/or any other type of information available to the monitor control unit 110.

The monitor control unit 110 may exchange communications with the sensors 122, the transmitter device 124, the electronic lock 126, and the application server 130 using multiple communication links. The multiple communication links may be a wired or wireless data pathways configured to transmit signals from sensors 122, the transmitter device 124, the electronic lock 126, and the application server 130 to the controller. The sensors 122, the transmitter device 124, the electronic lock 126, and the application server 130 may continuously transmit sensed values to the controller, periodically transmit sensed values to the monitor control unit 110, or transmit sensed values to the monitor control unit 110 in response to a change in a sensed value.

In some implementations, the monitor control unit 110 may additionally be used to perform routine surveillance operations on a property. For instance, the monitor control unit 110 may be assigned to one or more particular properties within a geographic location and may routinely collect surveillance footage during specified time periods (e.g., after dark), which may then be transmitted to the application server 130 for transmitting back to each particular property owner. In such implementations, the property owner may receive the surveillance footage over the network 105 as a part of a service provided by a security provider that operates the application server 130. For example, transmissions of the surveillance footage collected by the monitor control unit 110 may be part of a premium security service package provided by a security provider in addition to the routine drone emergency response service.

In some implementations, the monitor control unit 110 may monitor the operation of the electronic devices of the system 100 such as sensors 122, the transmitter device 124, the electronic lock 126, and the application server 130. For instance, the monitor control unit 110 may enable or disable the devices of the system 100 based on a set of rules associated with energy consumption, user-specified settings, and/or other information associated with the conditions near or within the property 101 where the system 100 is located. In some examples, the monitor control unit 110 may be used as a replacement to a traditional security panel (or monitor control unit) that is used to monitor and control the operations of the system 100. In other examples, the monitor control unit 110 may coordinate monitoring operations with a separate security panel of the system 100. In such examples, the monitor control unit 110 may monitor particular activities of the devices of the system 100 that are not monitored by the security panel, or monitor the operation of particular devices that are not monitoring by the security panel.

As described above, the property 101 may include various monitoring devices that are each capable of performing individual monitoring operations and/or capable to performing a set of coordinated operations based on instructions received from either the monitor control unit 110 or the application server 130. For instance, the property 101 may include the sensors 122, the transmitter device 124, the electronic lock 126, the application server 130 and other devices that provide monitoring data associated with devices, areas, or individuals located nearby or within the premises of the property 101. As an example, the sensors 122 located on the property 101 may include motion sensors, heat sensors, pressure sensors, resistive sensors, etc. that periodically collected sensed data indicating conditions of the property 101. The sensors 122 may communicate with the system 100 and transmit monitoring data for processing to the monitoring control unit 110. In some examples, the sensors 122 may store collected data locally or transmit monitoring data to be stored in a remote location (e.g., the application server 130).

The monitor control unit 110, the sensors 122, the transmitter device 124, and the electronic lock 126 may exchange data transmissions over the network 105 using multiple communication links. In some instances, the multiple communication links may include a local network within the network 105. For instance, the monitor control unit 110, the sensors 122, the transmitter device 124, the electronic lock 126, and the application server 130 may exchange data and commands over the local network as described herein. The local network may include 802.11 "Wi-Fi" wireless Ethernet (e.g., using low-power Wi-Fi chipsets), Z-Wave, Zigbee, Bluetooth, "Homeplug" or other "Powerline" networks that operate over AC wiring, and a Category 5 (CATS) or Category 6 (CAT6) wired Ethernet network. The local network may be a mesh network constructed based on the devices connected to the mesh network.

Referring now to the sensors 122, the system 100 may include one or more of a contact sensor, a motion sensor, a glass break sensor, an occupancy sensor, or any other type of sensor that can be included in an alarm or security system. The sensors 122 may also include an environmental sensor, such as a temperature sensor, a water sensor, a rain sensor, a wind sensor, a light sensor, a smoke detector, a carbon monoxide detector, an air quality sensor, etc. The sensors 122 may further include a health monitoring sensor, such as a prescription bottle sensor that monitors taking of prescriptions, a blood pressure sensor, a blood sugar sensor, a bed mat configured to sense presence of liquid (e.g., bodily fluids) on the bed mat, etc. In some examples, the sensors 122 may include a radio-frequency identification (RFID) sensor that identifies a particular article that includes a pre-assigned RFID tag.

The transmitter device 124 may be a wireless electronic device that may be activated by the user 102 to trigger an alarm signal to indicate the presence of an emergency condition within the property 101. In some instances, the transmitter device 124 may be placed on different articles of clothing of the user 102. For example, the transmitter device 124 may be a pendant worn around the user's neck, a small device worn on the user's belt, or a wristband placed on the user's arms. In other instances, the transmitter device 124 may be integrated with, or paired with, mobile electronic devices of the user 102. For example, the transmitter device 124 may be a smartphone that executes a mobile application associated with the application server 130, a wearable device such as a smart watch, or a companion device that is paired with a primary electronic device.

The transmitter device 124 may be an active device that requires the user 102 to take some action to indicate the presence of the emergency condition within the property 101 (e.g., through a button press on the transmitter device, an input on a user interface, etc.). Alternatively, the transmitter device 124 may be a passive device that monitors a present user condition (e.g., using a set of biometric parameters) and a present condition within the property (e.g., through data collected by the sensors 122 within the property 101). In such instances, the transmitter device 124 may use a specified algorithm to automatically detect the presence of an emergency condition within the property 101 without manual input from the user 102. For example, the transmitter device 124 can detect a fall, a lack of user activity, smoke, carbon monoxide, among other types of indicators. In other implementations, the transmitter device 124 may use a combination of active and passive monitoring techniques to detect the presence of an emergency condition within the property 101.

The electronic lock 126 may be a locking device that locks and unlocks the front door of the property 101. In some instances, the electronic lock 126 may be a stand-alone device with an electronic control assembly mounted directly to the lock. The electronic lock 126 may be configured to exchange data transmissions over the network 105 with the monitor control unit 110 and the application server 130. The electronic lock 126 may provide key control, access control, transaction logging and/or transaction logic based on the received data transmissions over the network 105. In addition, the electronic lock 126 may be remotely monitored and controlled to lock and unlock the front door of the property 101 in response to received data transmissions over the network 105.

The electronic lock 126 may use various locking mechanisms to lock and unlock the front door of the property by either supplying or removing power. In some instances, the electronic lock 126 may include a simple switch to temporarily provide access using a door release mechanism. In other instances, the electronic lock 126 may incorporate complex biometric-based access control systems. As examples, the electronic lock 126 may include at least one of an electromagnetic lock, electronic strikes, or electronic deadbolts and latches.

The application server 130 is an electronic device associated with a service provider. The service provider may be, for example, a healthcare organization that provides at-home medical treatment for users, a company that takes care of senior citizens in their homes, security and/or alarm companies that provide installation and/or ingoing education and periodic testing programs, or a service provider that relies on individually coordinated services that use a mobile application to communicate alerts to a list of personal contacts.

In some implementations, the service provider that maintains and/or operates the application server 130 may be the same entity that maintains the system 100 within the property 100. For example, the service provider may be an alarm company that provides security services to the property 101 through the monitor control unit 110. In other implementations, the service provider that operates the application server 130 may be a third-party entity that is different from the entity that provides security services to the property 101. For example, the application server 130 may be configured to receive security data collected at the property 101 in addition to receiving alarm signal data from the transmitter device 124.

The application server 130 may be configured to provide monitoring services by exchanging electronic communications with the monitor control unit 110 over the network 105. For example, the application server 130 may be configured to monitor events (e.g., initiation or termination of an emergency condition at the property 101, user activity data collected during the emergency condition, etc.) generated by the monitor control unit 110 and/or other devices connected over the network 105. In this example, the application server 130 may exchange electronic communications with the network module included in the monitor control unit 110 to receive information regarding events detected by the monitor control unit 110.

The application server 130 further includes a rule engine that utilizes a set of rules to identify and select an appropriate unlock instruction to transmit to the monitor control unit 110 in response receiving an alarm signal indicating the presence of an emergency condition at the property 101. For instance, the application server 130 may use a repository 132 that specifies different unlock instructions based on a combination of attributes associated with the nature of the alarm signal, attributes associated with the electronic lock 126, and other types of information.

In the examples depicted in FIG. 1, the repository 132 includes unlock instructions that specify different time periods for maintaining the electronic lock 126 in an unlocked state based on the type of emergency condition indicated by the received alarm signal. For example, if the received alarm signal indicates that the emergency condition at the property 101 is a medical emergency associated with the health condition of the user 102, then in response, the application server 130 may provide a door unlock instruction that automatically unlocks the electronic lock 126 and maintains it in an unlocked state for fifteen minutes. Alternatively, if the received alarm signal indicates that the emergency condition at the property 101 is a fire emergency, the in response, the application server 130 may provide a door unlock instruction that instead unlocks the front door for thirty minutes because of the increased time required to resolve the emergency condition and/or number of emergency responders 104 dispatched to the property 101. In another example, if the alarm signal is determined by the system 100 to be highly likely a false positive, then the application server 130 may instead perform a verification operation prior to transmitting a door unlock instruction. For example, the verification operation may include obtaining data collected from the sensors 122 in order to substantiate the emergency condition indicated by the received alarm signal. In yet another example, the application server 130 may provide a door unlock instruction that once the door is opened after it is unlocked and no motion is detected within the property for a predetermined amount of time, e.g., one, five, or ten minutes, the door should then be locked as emergency responders likely already responded and left with the user.

In addition to transmitting a door unlock instruction in response to receiving an alarm signal, the application server 130 may also transmit an alert notification to a user device 140 associated with an authorized caregiver 106. The authorized caregivers may be users that are designated by the user 102 to receive notifications related to the conditions associated with the user 102. Examples of authorized caregivers may include family members, neighbors, and/or healthcare providers that provide ongoing medical services to the user 102. The user device 140 may be an electronic device associated with the authorized caregiver 106 that is configured to exchange communications with the application server 130 over the network 105. For example, the user device 140 may be one or more of a smartphone, tablet, personal computer (PC), network-enabled media player, home entertainment system, cloud storage device, and other types of network devices.

Although the FIG. 1 illustrates the application server 130 generating different door unlock instructions based on the type of emergency indicated by the received alarm signal data (e.g., medical emergency, fire emergency), in some implementations, additional types of information may be used to generate different types of unlock instructions. For example, the application server 130 may also generate different unlock instructions based on the type of lock identified for the electronic lock 126, historical information associated with the user 102, and/or the data collected by the sensors 122. In another example, the application server 130 may generate different unlock instructions based on data received from the sensors 122. For instance, a room temperature measured by a temperature sensor located within the property may be used to determine a severity associated with a fire within the property 101, and in response, different door unlock instructions may be generated based on the severity of the fire (e.g., keeping the electronic lock 126 unlocked for longer periods of time for higher severity fires). In yet another example, the application server 130 may also generate user-specific door unlock instructions based on preferences previously provided by the user 102, the medical history associated the user 102, and/or property information associated with the property 101. For example, if the property 101 has multiple doors that each have individual electronic locks, property information may be used to generate the door unlock instruction such that only the door that is most likely to be used by emergency responders (e.g., front door) is unlocked by the generated door unlock instruction.

The user device 140 may execute a mobile application made available by an alarm provider that operates the application server 130. The application may refer to a software/firmware program running on the user device 140 that enables the user interface and features described throughout. The user devices 140 may load or install the application based on data received over a network (e.g., the network 105) or data received from local media. The native application may be capable or operating on various mobile devices platforms. The native application also enables the user device 140 to receive and process alarm signal data from the system 100. For example, the authorized caregiver 106 may receive the alert notifications indicating information associated with an emergency condition at the property 101 through the mobile application.

In some implementations, the user device 140 communicates with and receives system data from the monitor control unit 110 or the application server 130 using a communication link. For instance, the user device 140 may communicate with the monitor control unit 110 using various local wireless protocols such as Wi-Fi, Bluetooth, Zwave, Zigbee, HomePlug (Ethernet over powerline), or wired protocols such as Ethernet and USB, to connect the user device 140 to local security and automation equipment. The user device 140 may connect locally to the system 100 and sensors 122 and other devices. The local connection may improve the speed of status and control communications because communicating through the network 105 with a remote server (e.g., the application server 130) may be significantly slower.

In addition, in some instances, the generated door unlock instruction may be adjusted based the data received by the application server 130. For example, information associated with the received alarm signal data may be used to determine that the emergency condition is a fire emergency, but data received from the sensors 122 may be used to determine a severity of the emergency condition on the property 101. In this example, the application server 130 may adjust the baseline time period for which the electronic lock 126 is set to be unlocked based on the severity of the emergency condition indicated by the data collected by the sensors 122 (e.g., keeping the electronic lock 126 unlocked for a longer time period if the severity is determined to be higher than anticipated).

In some implementations, the application server 130 may determine the door unlock instruction based on information received from the emergency responders 104. For example, the application server 130 may obtain data indicating an average response time for the nearest emergency responder, identify an anticipated time point of arrival, and then transmit the door unlock instruction prior to the arrival of the emergency responders. In some instances, the application server 130 may also obtain an indication from the emergency responders 104 after the emergency condition has been terminated and in response, automatically transmit an instruction to re-lock the electronic lock 126.

For instance, the monitor control unit 110 or the application server 130 may determine that the emergency condition at the property 101 has ended based on monitoring the emergency condition of the property 101. As described above, if a GPS location of a user device associated with the user 102 indicates that the user 102 has been transported out of the property 101, the monitor control unit or the application server 130 may determine that the emergency condition has ended. Other examples of data that can be used to indicate that the emergency condition has ended may include occupancy data indicating that the emergency responders 104 have left the property 101, sensor data indicating that the condition of the property has normalized, or data from either the user 102 or the caregiver 106 indicating that the emergency condition at the property 101 has ended.

In some implementations, the transmitter device 124 may be a separate after-market component that is separate from the system 100. For example, the transmitter device 124 may be a PERS device that is provided separately from security devices such as the monitor control unit 110 or the application server 130. In such implementations, the transmitter device 124 can be separately configured to exchange communications with the devices associated with the system 100 (e.g., through a mobile application or a shared network connection).

In some implementations, the electronic lock 126 can be used to automatically unlock structures or features of the property 101 other than doors or windows. For instance, the electronic lock 126 can be placed on garage door and configured such that, when it receives an unlock instruction, the electronic lock 126 causes the garage door to open. In such instances, the system 100 can automatically unlock the garage door using the unlock instructions included within the repository 132. For example, the system 100 can transmit an unlock instruction to the electronic lock 126 to open the garage door in response to obtaining data collected by a carbon monoxide sensor indicating that a high level of carbon monoxide in the garage.

In other instances, the electronic lock 126 can additionally, or alternatively, be placed on a gate of the property 101 and used to provide automatic gate control. For example, the electronic lock 126 can be placed on a driveway gate and associated with an actuating system that physically opens gate when the electronic lock 126 receives an unlock instruction from the system 100. In this example, the system 100 can use an unlock instruction included within the repository 132 that is transmitted to the electronic lock 126 in response to obtaining data collected by driveway sensors that indicates that a user such is about to leave or enter the driveway through the driveway gate. In some instances, this unlock instruction can be transmitted to the electronic lock 126 once an emergency condition is detected at the property 101 and an emergency responder is detected to be located nearby the gate.

Figure 2:
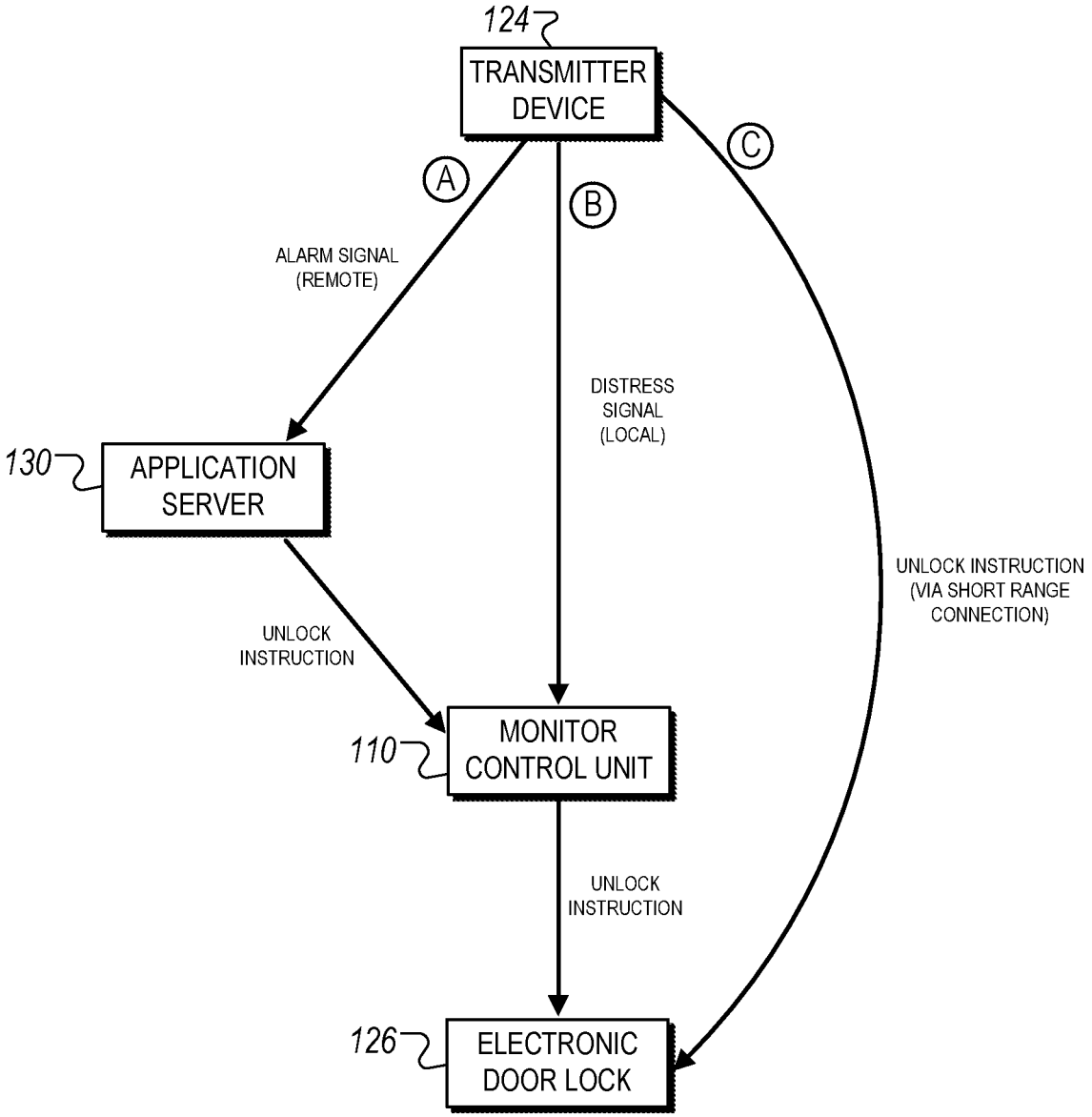
FIG. 2 is a schematic diagram that illustrates examples of different signaling mechanisms of an emergency door unlock signal.

FIG. 2 illustrates examples of different signaling pathways of an emergency door unlock signal. In the figure, signaling pathways A, B, and C represent alternative techniques to process alarm signal data provided by the transmitter device 124 and generate an emergency door unlock signal that is then transmitted the electronic lock 126. As described previously, the transmitter device 124 may actively generate an alarm signal based on an input from the user 102 (e.g., through a physical button press, or through an input provided on a user interface), or passively through monitoring user activity data and/or data collected by the sensors 122 (e.g., detecting a user fall that indicates that the user may need medical assistance).

Referring initially to signaling pathway A, the transmitter device 124 transmits alarm signal data to the application server 130 over the network 105 (either directly, or through the monitor control unit 110). Upon receiving the alarm signal, the application server 130 then generates an unlock instruction using techniques described previously with respect to FIG. 1 and then relays the unlock instruction to the electronic lock 126 through the monitor control unit 110. In this pathway, the alarm signal is transmitted over a WAN outside a local network of the property 101 such as the Internet or through a cellular network. This pathway may be used, for example, if the emergency monitoring services are provided by a third-party entity that is separate from the security provider.

Referring now to signaling pathway B, the transmitter device 124 transmits a distress signal data locally to the monitor control unit 110 without establishing communications with the application server 130. In this example, the monitor control unit 110 is capable of utilizing a rule engine to determine an unlock instruction without exchanging any communications with the application server 130. This pathway may be used, for example, if the emergency monitoring services are provided by the same entity that also provides security services to the property 101. For example, the monitor control unit 110 may locally store the repository 132 identifying different door unlock instructions for different types of distress signal information. In this regard, the monitor control unit 110 intelligently determines the appropriate door unlock instruction without the application server 130.

Compared to the signaling pathway A, the transmitter device transmits a distress signal (as opposed to an alarm signal) because remote communications with the application server 130 are not necessary in order to transmit the door unlock instruction to the electronic lock 126. In this regard, a distress signal represents a local data transmission that is independent of the security network associated with the application server 130, whereas the alarm signal as described with respect to the signaling pathway A, can be transmitted through the security network of the property 101, or independently of the security network of the property 101.

Referring now to signaling pathway C, the transmitter device 124 may be capable of both generating the unlock instruction as well as the door unlock instruction, and then directly transmit the unlock instruction to the electronic lock 126. This pathway may be used, for example, if the transmitter device 124 is a smart phone or other type of mobile electronic computing device that has both transmitting and processing capabilities. As an example, a transmitter device that is a smart phone can run a mobile application that receives user input through a user interface, and also processes the user input to determine an appropriate door unlock instruction. In addition, the application of the transmitter device 124 may be capable of using short range wireless communication techniques to transmit data directly to the electronic lock 126. For example, the transmitter device 124 may directly transmit the door unlock instruction to the electronic lock 126 through a paired Bluetooth connection. In another example, the transmitter device 124 and the electronic door lock may exchange communications using a Z-wave signal, an infrared (IR) signal, or a near-field communication (NFC) signal.

In some implementations, the system 100 may be capable of dynamically adjusting the particular signaling mechanism used to transmit the door unlock instruction to the electronic lock 126. For instance, the system 100 may adjust the signaling mechanism if a particular pathway is determined to be unavailable and/or would cause significant latency in transmitting the alarm signal data over the particular signaling pathway. As an example, if a fire emergency in the property 101 causes power loss that renders the monitor control unit 110 inoperable, the system 100 may adjust the transmission of the unlock instruction using the signaling pathway C, which is not network-dependent, instead of the signaling pathways A or B, which require power to the monitor control unit 110. In another example, if the network connectivity within the property 101 is diminished due to the emergency condition, then the system 100 may opt to have the transmitter device 124 transmit a distressed signal to the monitor control unit 110 using the signaling pathway B rather than the signaling pathway A since the monitor control unit 110 is locally connected to the transmitter device 124 whereas the application server 130 is remotely connected. In yet another example, if the monitor control unit 110 is damaged and unable to accept incoming data transmissions, then the system 100 may opt to transmit an alarm signal through the signaling pathway 130, or a direct transmission of the door unlock instruction to the electronic lock 126 through the signaling pathway C.

Figure 3:
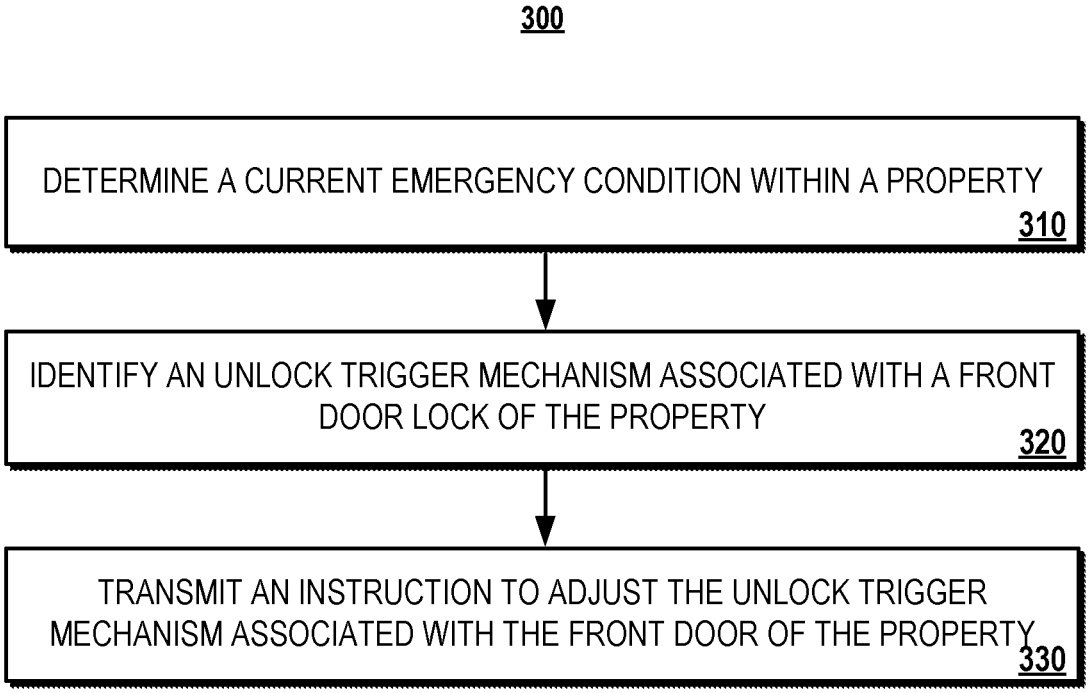
FIGS. 3-5 are flowcharts that illustrate examples of different emergency door unlock instruction transmission sequences.
Figure 4:
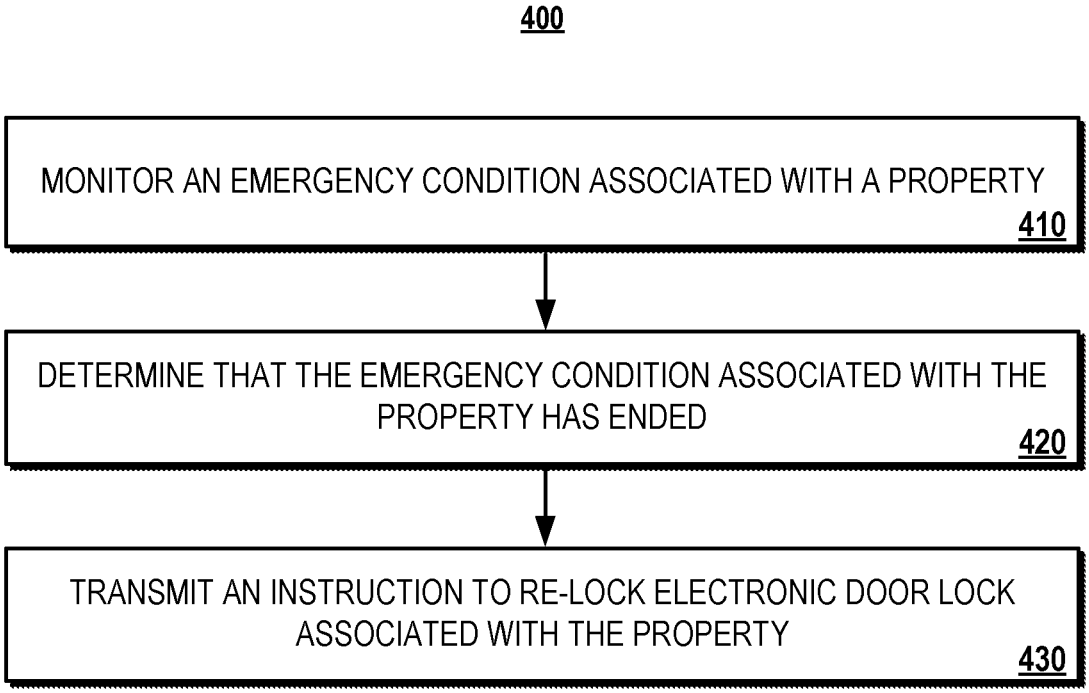
Figure 5:
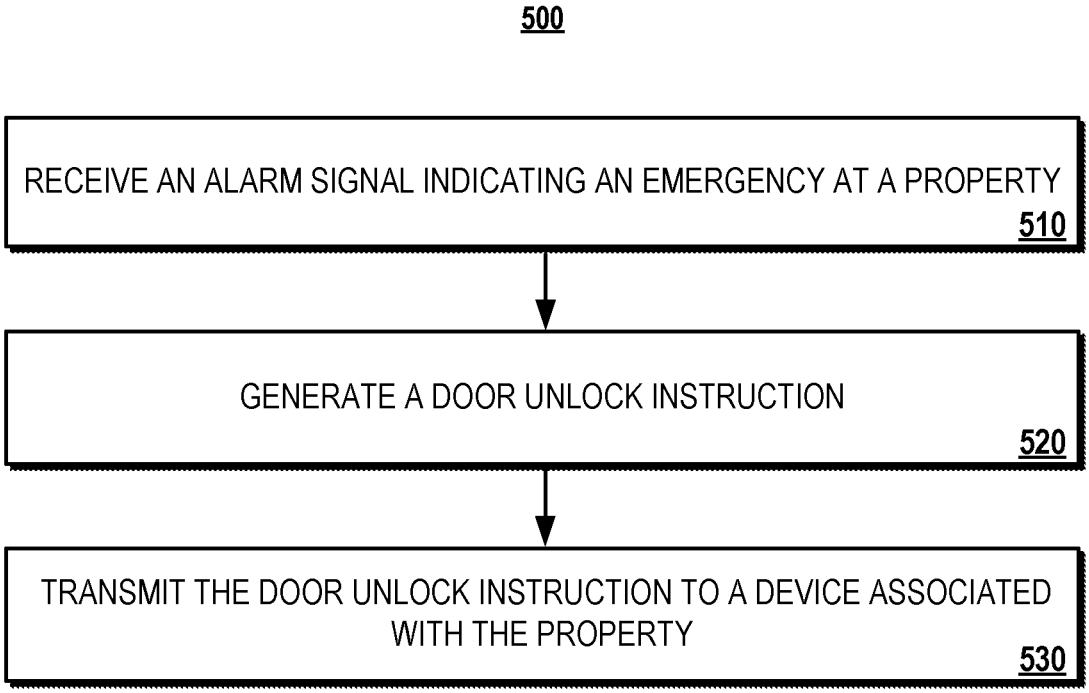

FIGS. 3-5 illustrates examples of different emergency door unlock instruction transmission sequences. Referring initially to FIG. 3, a process 300 may be used to transmit an automatic door unlock instruction based on the trigger mechanism of a door lock. Briefly, the process 300 may include determining a current emergency condition within a property (310), identifying an unlock trigger mechanism associated with a front door lock of the property (320), and transmitting an instruction to adjust the unlock trigger mechanism associated with the front door of the property (330).

In more detail, the process 300 may include determining a current emergency condition within a property (310). For instance, as described previously, the monitor control unit 110 may initially receive a distress signal generated and transmitted from the transmitter device 124. In some implementations, the distress signal may indicate a type of emergency present within the property 101 and associated information. Examples of the associated information can include user activity data of the user 102 (e.g., heart rate data, step data, fall detection data, etc.), sensor data collected by the sensors 122 (e.g., smoke levels, carbon monoxide levels, current temperature at the property 101, present video footage of the user 102, user movement data, etc.).

The process 300 may include identifying an unlock trigger mechanism associated with a front door lock of the property (320). For instance, the monitor control unit 110 or the application server 130 may obtain data indicating a lock type associated with the electronic lock 126. The obtained data can then be used to identify the trigger mechanism that can be used to automatically unlock the electronic lock 126. For example, the obtained data may be used to determine if the electronic lock 126 has an auto-lock feature (e.g., automatic lock feature every ninety seconds) that requires additional instructions to keep the electronic lock 126 unlocked during the presence of the emergency condition at the property 101. In another example, the obtained data can be used to determine the physical locking mechanism used to lock the electronic lock 126 (e.g., electromagnetic lock, electronic strikes, electronic deadbolts and latches).

The process 300 may include transmitting an instruction to adjust the unlock trigger mechanism associated with the front door of the property (330). For instance, the monitor control unit 110 or the application server 130 may initially generate a door unlock instruction based on the identified unlock trigger mechanism. For example, if the identified locking mechanism of the electronic lock 126 indicates an automatic locking feature, then the generated door unlock instruction may either include an additional instruction to disable the auto-lock feature or specify that the unlock instruction should be periodically transmitted over a time frame associated with the emergency condition (e.g., an unlock transmission frequency that is higher than the auto-lock feature of the electronic lock 126). In another example, the generated door unlock instruction specifies a specific protocol that is associated with the particular unlocking mechanism of the electronic lock 126.

The door unlock instruction can then be transmitted to the electronic lock 126 using one of the signaling pathway depicted in FIG. 2. In some implementations, the door unlock instruction may be generated by the application server 130 and transmitted to the electronic lock 126 through the monitor control unit 110 (e.g., using signaling pathway A). In other implementations, the door unlock instruction may be locally generated by the monitor control unit 110 and transmitted directly to the electronic lock 126 (e.g., using signaling pathway B). Alternatively, the door unlock instruction may also be generated by the transmitter device 124 and transmitted directly to the electronic lock 126 without using the network 105 (e.g., using the signaling pathway C).

Referring now to FIG. 4, a process 400 may be used to transmit an automatic door relock signal after determining an emergency condition associated with a property. Briefly, the process 400 may include monitoring an emergency condition associated with a property (410), determining that the emergency condition associated with the property has ended (420), and transmitting an instruction to re-lock electronic door lock associated with the property (430).

In more detail, the process 400 may include monitoring an emergency condition associated with a property (410). For instance, after receiving the alarm signal indicating an emergency condition at the property 101, the monitor control unit 110 or the application server 130 may periodically monitor the present condition of the property 101 to determine if the emergency condition still persists within the property 101. For example, the monitor control unit 110 or the application server 130 may obtain occupancy data collected by the sensors 122 to determine if dispatched emergency responders have arrived and left the property 101 after responding to the alarm signal. In another example, the monitor control unit 110 or the application server 130 may monitor user data (e.g., GPS location associated with a device associated with the user 102, or user activity data measured by user monitoring devices) and determine if the user has been transported out of the property 101. In some instances, the user 102 may have the ability to provide a manual input indicating that the emergency condition at the property 101 has ended. In such instances, the monitor control unit 110 or the application server 130 monitors data communications over the network 105 for the manual input.

The process 400 may include determining that the emergency condition associated with the property has ended (420). For instance, the monitor control unit 110 or the application server 130 may determine that the emergency condition at the property 101 has ended based on monitoring the emergency condition of the property 101. As described above, if a GPS location of a user device associated with the user 102 indicates that the user 102 has been transported out of the property 101, the monitor control unit or the application server 130 may determine that the emergency condition has ended. Other examples of data that can be used to indicate that the emergency condition has ended may include occupancy data indicating that the emergency responders 104 have left the property 101, sensor data indicating that the condition of the property has normalized, or data from either the user 102 or the caregiver 106 indicating that the emergency condition at the property 101 has ended.

The process 400 may include transmitting an instruction to re-lock an electronic lock associated with the property (430). For instance, in response to determining that the emergency condition at the property 101 has ended, the monitor control unit 110 or the application server 130 may transmit an instruction to re-lock the electronic door 126 of the property 101. The instruction may be used to prevent any security risks to the property 101 after the emergency condition has ended when the property 101 is likely to be vacant. In this regard, the monitor control unit 110 or the application server 130 may automatically re-lock the property once entrance into the property is no longer needed to address the emergency condition.

Referring now to FIG. 5, a process 500 may be used to determining a door unlock instruction based on a received an alarm signal indicating an emergency condition at a property. Briefly, the process 500 may include receiving an alarm signal indicating an emergency at a property (510), generating a door unlock instruction (520), and transmitting the determined door unlock instruction to a device associated with the property (530).

In more detail, the process 500 may include receiving an alarm signal indicating an emergency at a property (510). For instance, the monitor control unit 110 or the application server 13 may receive an alarm signal indicating an emergency condition at the property 101. As described previously, the emergency condition represents any circumstance that require the emergency responders 104 to enter into the property 101 because the user 102 requires assistance. Examples of emergency conditions may include a health-related emergency associated with the user 102, a fire at the property 101. In some implementations, the alarm signal may include additional data such as, for example, user activity data collected by wearable devices or property information collected by the sensors 122.

The process 500 may include generating a door unlock instruction (520). For instance, the monitor control unit 110 or the application server 130 may utilize a rule engine to identify and select an applicable door unlock instruction from the repository 132. The applicable unlock instruction may be identified based on different types of information associated with the electronic lock 126. For example, such information may include the particular emergency condition at the property 101 indicated by the received alarm signal, the locking mechanism of the electronic lock 126, data collected by the sensors 122, user activity data associated with the user 102, among other types of information. In addition, the generated door unlock instruction may specify additional protocols that are specifically targeted to the features associated with the electronic lock 126. For example, if the electronic lock 126 has an auto-lock feature, the door unlock instruction may include a protocol to periodically unlock the electronic lock 126.

The process 500 may include transmitting the determined door unlock instruction to a device associated with the property (530). For instance, the monitor control unit 110 or the application server 130 may transmit the generated door unlock instruction to the electronic lock 126. For example, as depicted previously with respect to FIG. 2, the door unlock instruction may be transmitted using different signaling pathways between the transmitter device 124 and the electronic lock 126.

Figure 6:
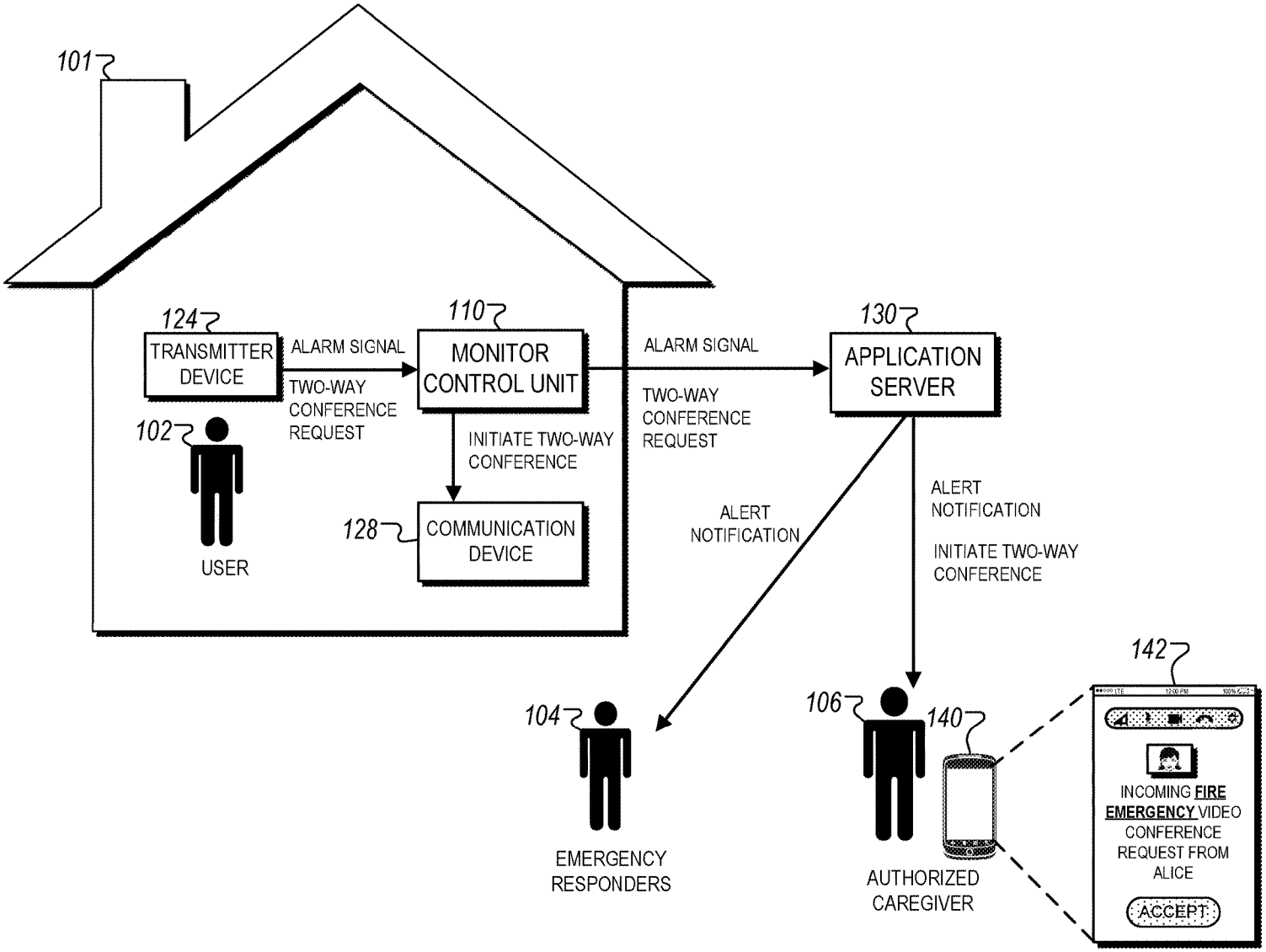
FIG. 6 is a schematic diagram that illustrates an example of a transmission sequence of an automated emergency video conference signal.

FIG. 6 illustrates an example of a transmission sequence of an automated emergency video conference signal. The transmission sequence depicted enables the system 100 to automatically initiate a two-way conference between the user 102 and the authorized caregiver 106 during an emergency condition at the property 101. For instance, the two-way conference may be initiated in order to allow the authorized caregiver 106 to assist the user 102 directly before the emergency responders 104 are either dispatched or arrive at the property 101. In this regard, the system 100 provides a means to establish communications beyond automatic reporting the emergency condition to the application server 130.

The two-way conference between the user 102 and the authorized caregiver 106 may be any type of communication that enables the transmission of information between the user 102 and the authorized caregiver 106 over a shared network pathway. For example, the two-way conference may be one or more of a video conference, an audio conference, or a text chat between a communication device 128 associated with the user 102 and the user device 140 associated with the authorized caregiver 106. The communication device 128 may be an electronic device that is configured to continuously or periodically monitor the user 102 (e.g., a video camera placed in a specified location of the property 101) or a user device associated with the user 102 (e.g., a smart phone of the user 102).

The system 100 as depicted in FIG. 1 enables the user 102 to use the transmitter device 124 transmit an alarm signal over the network 105, which is then used to generate a door unlock instruction to automatically unlock the electronic lock 126 to allow easier entrance into the property 101. In the example depicted in FIG. 6, a separate two-way conference request may be transmitted at the same time as the alarm signal to automatically initiate a two-way conference. The two-way conference can be initiated prior to the arrival of the emergency responders 104 that are dispatched in response to the transmitted alarm signal and may continue until the authorized caregiver 106 ends the conference.

In some implementations, the two-way conference request may be embedded within the alarm signal and processed by the monitor control unit or the application server 130 using the same signaling pathway as described previously with respect to FIG. 1. In other implementations, the two-way conference request may be transmitted through a separate signaling pathway such that the alarm signal and the two-way conference request are separately handled throughout the transmission sequence.

The transmission sequence initially begins when the user activates the transmitter device 124 to automatically generate the alarm signal indicating the emergency condition within the property 101. The activation of the transmitter device 124 also automatically generates signal for a two-way conference request. Both the alarm signal and the two-way conference request are then transmitted to the monitor control unit 110.

The monitor control unit 110 then processes the received alarm signal data and the two-way conference request and transmits the processed data to the application server 130 and also transmits an instruction to initiate a two-way conference to the communication device 128. In some instances, the monitor control unit 110 may identify an authorized caretaker to contact from among a list of authorized caretakers, and then transmit the identified authorized caretaker both the communication device 128 and the application server 130. The authorized caretaker to be contacted may be selected based on, for example, the type of emergency condition indicated by the received alarm signal, or based on a predetermined priority score that was previously indicated by the user's emergency contact list.

Upon receiving the alarm signal and the two-way conference request from the monitor control unit 110, the application server 130 may then transmit an alert notification to both the emergency responders 104 and the authorized caregiver 106. The alert notification may be transmitted using techniques described previously with respect to FIG. 1. In addition, the application server 130 may also transmit an instruction to initiate a two-way conference to the user device 140 of the authorized caregiver 106 that was identified by the monitor control unit 110 as the caregiver to contact.

The user device 140 may then provide a user interface 142 to the authorized caregiver 106 that presents information associated with the emergency condition indicated by the alarm signal. For example, as depicted in FIG. 6, the user interface 142 may include information related to the emergency condition, along with an option to accept an incoming video transmission from the communication device 128. If the authorized caregiver 106 accepts the incoming request, then a two-way conference is established between the communication device 128 and the user device 140 to provide the authorized caregiver with pertinent information as to the present condition of the user 102 and/or the property 101.

In some implementations, the transmission sequence for the two-way conference requested as depicted may be iteratively performed for multiple authorized caregivers if, for example, a particular caregiver is either unreachable, or unresponsive. In such implementations, the monitor control unit 110 may initiate sequential conference requests with multiple authorized caregivers included within an emergency contact list based on a priority score indicating which particular users should be contacted first. In some implementations, the monitor control unit 110 may dynamically select the type of conference to initiate based on the severity indicated by the emergency condition. For example, the monitor control unit 110 may initiate a video conference if the emergency condition is determined to be life-threatening (e.g., the user 102 suffering a heart attack), but initiate an audio conference if the emergency condition is not life threatening (e.g., the user 102 has fallen and needs assist to stand up).

In some implementations, instead of routing the two-way conference request through the application server 130 as depicted in FIG. 6, the system 100 may instead be configured to initiate the two-way conference directly between the communication device 128 and the user device 140. For example, after transmitting the instruction to transmit the two-way conference to the communication device 128, the communication device 128 may then directly establish communications with the user device 140 (e.g., through the use of a shared mobile application). In such implementations, the two-way communication may either be established using cellular connection, the Internet, or a combination of both.

Figure 7:
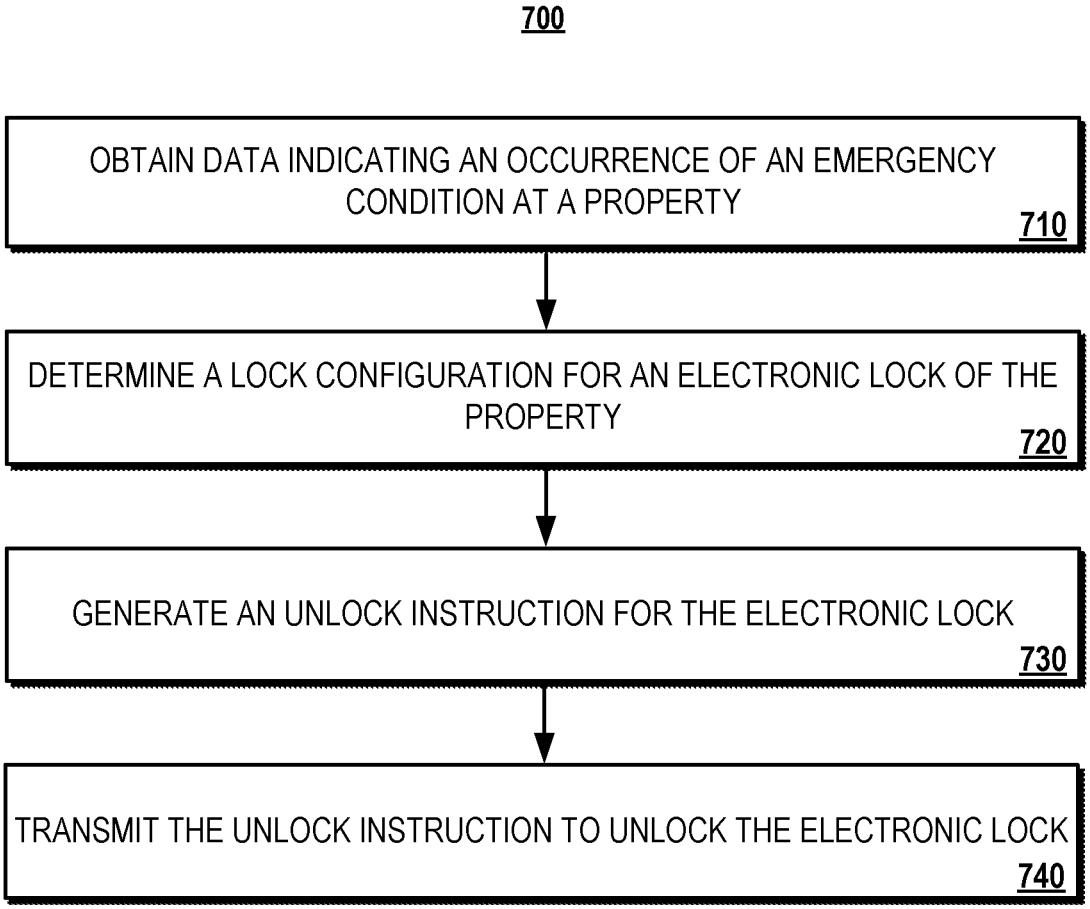
FIG. 7 is a flowchart that illustrates an example of a process for automatically unlocking an electronic lock during an emergency condition at a property.

FIG. 7 is a flowchart that illustrates an example of a process 700 for automatically unlocking an electronic lock during an emergency condition at a property. In general, the process 700 can include the operations of obtaining data indicating an occurrence of an emergency condition at a property (710), determining a lock configuration for an electronic lock of the property (720), generating an unlock instruction for the electronic lock (730), and transmitting the unlock instruction to unlock the electronic lock (740).

The process 700 is described below in reference to system 100, although other systems may be configured to perform the operations of the process 700. In one example, the operations of the process 700 can be performed by the monitor control unit 110 in response to detecting an emergency condition at the property, e.g., a fire emergency condition, a medical emergency, etc. In another example, the operations of the process 700 can be performed by an associated server system such as the application server 130 that is in communication with the monitor control unit 110 over a network, e.g., the Internet and a local area network (LAN) of the network 105. In other examples, the operations of the process 700 can be performed by a combination of components of the system 100.

The process 700 can include the operation of obtaining data indicating an occurrence of an emergency condition at a property (710). For example, the monitor control unit 110 and/or the application server 130 can obtain data that indicates an occurrence of an emergency condition at the property 101. As discussed above, the occurrence can be determined by different electronic devices included within and/or associated with the system 100. In some implementations, the occurrence is detected by one or more of the sensors 122 based on sensor data collected from the environmental conditions inside and/or nearby the property 101. For example, the occurrence of a fire emergency condition can be determined based on a temperature sensor detecting an abnormally high indoor temperature inside the property 101.

In other implementations, the occurrence is detected by an external device such as the transmitter device 124 that may or may not be a component of the system 100. For instance, as discussed above with respect to FIG. 1, the transmitter device 124 is an electronic device that is provided as a companion device when the monitoring system is installed within the property 101. In other instances, the transmitter device 124 is an aftermarket PERS device that the user 102 obtains independently of the monitoring system 100. In such instances, the PERS device is capable of exchanging communications, e.g., network-based communications or proximity-based communications, with other electronic devices of the monitoring system 100. For example, the PERS device may detect the occurrence of a medical emergency based on receiving a user input indicating that the user 102 has physically pressed on a distress button on the PERS device. In various other implementations, the occurrence of other types of emergency condition can be determined by the monitoring system 100, e.g., carbon monoxide leakage, flooding/water damage, and/or other types of conditions that might require emergency responders to enter the property 101.

The process 700 can include the operation of determining an electronic lock of the property (720). For example, the monitor control unit 110 and/or the application server 130 may initially determine that the property 101 includes an electronic door lock such as the electronic lock 126. The monitor control unit 110 and/or the application server 130 may also identify additional information associated with the electronic lock 126. In some implementations, the monitor control unit 110 and/or the application server 130 may determine a lock type, a locking/unlocking mechanism, and/or security features associated with the electronic lock 126. As an example, if the electronic lock 126 is a type of lock that automatically re-locks after being unlocked, the monitor control unit 110 and/or the application server 130 may identify the period of time during which the electronic lock 126 remains unlocked prior to being re-locked. As another example, the monitor control unit 110 and/or the application server 130 may identify the control mechanism used to unlock or lock electronic lock 126, e.g., padlocks, deadbolts, knob locks, lever handle locks, etc.

In some implementations, where a property has multiple electronic locks, the monitor control unit 110 and/or the application server 130 may determine a particular electronic lock from among the multiple identified electronic locks that represents the lock for an entrance through which an emergency responder may enter into the property. For example, the monitor control unit 110 and/or the application server 130 may access stored mapping data that identifies an entrance, e.g., front entrance, back entrance, side door, upstairs window, etc., that corresponds to each electronic lock. In this example, the monitoring system 100 may store a score for each electronic lock that reflects a respective likelihood that an emergency responder will enter the property 101 through a particular entrance corresponding to an electronic lock. For instance, a front entrance of a property can be assigned a higher score than a back entrance of the property based on a higher likelihood that a fire fighter will enter the property through the front entrance. The system, in this example, can output data indicating the respective scores to first responders, e.g., a notice indicating that the side door is unlocked.

The process 700 can include the operation of generating instruction for the electronic lock (730). For example, the monitor control unit 110 and/or the application server 130 may generate an unlock instruction for the electronic lock 126. The unlock instruction can specify, for instance, a mechanism to unlock the electronic lock 126 based on the determined lock type of the electronic lock 126.

In some implementations, the monitor control unit 110 and/or the application server 130 generates the unlock instruction includes determining a lock classification for the electronic lock and determining a configuration corresponding to the determined lock configuration for the electronic lock 126. In such implementations, the lock classification can represent, for example, a lock type of the electronic lock 126, whether the electronic lock 126 automatically unlocks after a specified period of time, the mode of communication used by the electronic lock 126, among others. The configuration, in these implementations, can identify a unlock mechanism to unlock the electronic lock 126. For example, the configuration can specify whether the electronic lock 126 is unlocked once or unlocked periodically over a specified time period, and/or an associated access code used to lock/unlock the electronic lock 126.

In some implementations, where the electronic lock 126 automatically locks after being unlocked for a certain period of time, the unlock instruction can be configured to cause the electronic lock 126 to periodically unlock throughout a time period when ingress and egress is expected through the property 101, e.g., during a rescue period when emergency responders are moving through the property 101. For example, if the emergency condition at the property 101 is a fire emergency, and the electronic lock 126 is a type of lock that automatically locks after being unlocked, the unlock instruction may be configured to cause the electronic lock 126 to unlock periodically so that fire fighters can continuously enter and exit the property 101 while extinguishing a fire.

In some implementations, generating the unlock instruction for the electronic luck 126 includes determining an emergency classification for the emergency condition detected at the property 101. In such implementations, the monitor control unit 110 and/or the application server 130 may generate the unlock instruction corresponding the emergency classification determined for a determined emergency condition. The monitor control unit 110 and/or the application server 130 may generate a different unlock instruction for each type of emergency classification. As shown in the example depicted in FIG. 1, the application server 130 may store a repository 132 that specifies an unlock instruction that keeps the electronic lock 126 unlocked for fifteen minutes if the determined emergency classification is a medical emergency, or alternatively, an unlock instruction that keeps the electronic lock 126 unlocked for thirty minutes if the determined emergency classification is a fire emergency.

The process 700 can include the operation of transmitting the unlock instruction to unlock the electronic lock (740). For example, the monitor control unit 110 and/or the application server 130 may transmit the unlock instruction to unlock the electronic lock 126. As discussed above, the unlock instruction can specify one or more configurations that adjust the way in which the electronic lock 126 is unlocked, e.g., unlock time period, physical mechanism to unlock, etc. In this regard, the unlock instruction can be transmitted to the electronic lock 126 such that, when the electronic lock 126 receives the unlock instruction, the electronic lock 126 is unlocked according to the configurations specified by the unlock instruction.

The described systems, methods, and techniques may be implemented in digital electronic circuitry, computer hardware, firmware, software, or in combinations of these elements. Apparatus implementing these techniques may include appropriate input and output devices, a computer processor, and a computer program product tangibly embodied in a machine-readable storage device for execution by a programmable processor. A process implementing these techniques may be performed by a programmable processor executing a program of instructions to perform desired functions by operating on input data and generating appropriate output. The techniques may be implemented in one or more computer programs that are executable on a programmable system including at least one programmable processor coupled to receive data and instructions from, and to transmit data and instructions to, a data storage system, at least one input device, and at least one output device. Each computer program may be implemented in a high-level procedural or object-oriented programming language, or in assembly or machine language if desired; and in any case, the language may be a compiled or interpreted language. Suitable processors include, by way of example, both general and special purpose microprocessors. Generally, a processor will receive instructions and data from a read-only memory and/or a random access memory. Storage devices suitable for tangibly embodying computer program instructions and data include all forms of non-volatile memory, including by way of example semiconductor memory devices, such as Erasable Programmable Read-Only Memory (EPROM), Electrically Erasable Programmable Read-Only Memory (EEPROM), and flash memory devices; magnetic disks such as internal hard disks and removable disks; magneto-optical disks; and Compact Disc Read-Only Memory (CD-ROM). Any of the foregoing may be supplemented by, or incorporated in, specially designed application-specific integrated circuits (ASICs).

It will be understood that various modifications may be made. For example, other useful implementations could be achieved if steps of the disclosed techniques were performed in a different order and/or if components in the disclosed systems were combined in a different manner and/or replaced or supplemented by other components. Accordingly, other implementations are within the scope of the disclosure.

What is claimed is:

1. A method performed by one or more computers, the method comprising:

obtaining data indicating (i) an emergency detected at a property and (ii) context data associated with the emergency;

selecting, from among a set of unlock instructions for unlocking an electronic lock, a particular unlock instruction based at least on the context data, wherein each unlock instruction included in the set of unlock instructions specifies a different time period for keeping the electronic lock unlocked; and enabling transmission of the particular unlock instruction to the electronic lock such that the electronic lock is kept unlocked for a corresponding time period specified by the particular unlock instruction.

2. The method of claim 1, wherein:

the context data comprises an emergency classification for the emergency detected at the property;

each unlock instruction included in the set of unlock instructions is associated with a different emergency classification; and the particular unlock instruction is selected from the set of unlock instructions based on the emergency classification determined for the emergency detected at the property.

3. The method of claim 2, wherein the emergency classification for the emergency detected at the property indicates a severity level of the emergency detected at the property.

4. The method of claim 1, wherein:

the context data indicates that (i) the emergency detected at the property is a fire emergency and (ii) an ambient temperature of the property that is detected by one or more sensors located in the property; and the method further comprises determining a severity level for the fire emergency based on the ambient temperature of the property.

5. The method of claim 1, wherein:

the emergency detected at the property is detected by a server associated with a monitoring system located in the property; and the set of unlock instructions is remotely generated by the server;

enabling transmission of the particular unlock instruction to the electronic lock comprises transmitting, by the server, the particular unlock instruction to a control unit of the monitoring system.

6. The method of claim 1, wherein:

the emergency detected at the property is detected by a monitoring system located in the property;

the set of unlock instructions is locally generated by the monitoring system; and enabling transmission of the particular unlock instruction to the electronic lock comprises transmitting, by the monitoring system, the particular unlock instruction to the electronic lock.

7. The method of claim 1, wherein the emergency at the property is detected by a third-party electronic device that is not a component of a monitoring system located in the property.

8. The method of claim 1, further comprising:

determining that the emergency detected at the property has terminated; and based on determining that the emergency detected at the property has terminated, enabling transmission of a lock instruction to the electronic lock such that the electronic lock is locked according to the lock instruction.

9. A system comprising:

one or more computing devices; and one or more storage devices storing instructions that, when executed by the one or more computing devices, cause the one or more computing devices to perform operations comprising:

obtaining data indicating (i) an emergency detected at a property and (ii) context data associated with the emergency;

selecting, from among a set of unlock instructions for unlocking an electronic lock, a particular unlock instruction based at least on the context data, wherein each unlock instruction included in the set of unlock instructions specifies a different time period for keeping the electronic lock unlocked; and enabling transmission of the particular unlock instruction to the electronic lock such that the electronic lock is kept unlocked for a corresponding time period specified by the particular unlock instruction.

10. The system of claim 9, wherein:

the context data comprises an emergency classification for the emergency detected at the property;

each unlock instruction included in the set of unlock instructions is associated with a different emergency classification; and the particular unlock instruction is selected from the set of unlock instructions based on the emergency classification determined for the emergency detected at the property.

11. The system of claim 10, wherein the emergency classification for the emergency detected at the property indicates a severity level of the emergency detected at the property.

12. The system of claim 9, wherein:

the context data indicates that (i) the emergency detected at the property is a fire emergency and (ii) an ambient temperature of the property that is detected by one or more sensors located in the property; and the operations further comprise determining a severity level for the fire emergency based on the ambient temperature of the property.

13. The system of claim 9, wherein:

the emergency detected at the property is detected by a server associated with a monitoring system located in the property; and the set of unlock instructions is remotely generated by the server;

enabling transmission of the particular unlock instruction to the electronic lock comprises transmitting, by the server, the particular unlock instruction to a control unit of the monitoring system.

14. The system of claim 9, wherein:

the emergency detected at the property is detected by a monitoring system located in the property;

the set of unlock instructions is locally generated by the monitoring system; and enabling transmission of the particular unlock instruction to the electronic lock comprises transmitting, by the monitoring system, the particular unlock instruction to the electronic lock.

15. The system of claim 9, wherein the emergency at the property is detected by a third-party electronic device that is not a component of a monitoring system located in the property.

16. At least one non-transitory computer-readable storage device storing instructions that, when executed by one or more processors, cause the one or more processors to perform operations comprising:

obtaining data indicating (i) an emergency detected at a property and (ii) context data associated with the emergency;

selecting, from among a set of unlock instructions for unlocking an electronic lock, a particular unlock instruction based at least on the context data, wherein each unlock instruction included in the set of unlock instructions specifies a different time period for keeping the electronic lock unlocked; and enabling transmission of the particular unlock instruction to the electronic lock such that the electronic lock is kept unlocked for a corresponding time period specified by the particular unlock instruction.

17. The non-transitory computer-readable storage device of claim 16, wherein:

the context data comprises an emergency classification for the emergency detected at the property;

each unlock instruction included in the set of unlock instructions is associated with a different emergency classification; and the particular unlock instruction is selected from the set of unlock instructions based on the emergency classification determined for the emergency detected at the property.

18. The non-transitory computer-readable storage device of claim 17, wherein the emergency classification for the emergency detected at the property indicates a severity level of the emergency detected at the property.

19. The non-transitory computer-readable storage device of claim 16, wherein:

the context data indicates that (i) the emergency detected at the property is a fire emergency and (ii) an ambient temperature of the property that is detected by one or more sensors located in the property; and the operations further comprise determining a severity level for the fire emergency based on the ambient temperature of the property.

20. The non-transitory computer-readable storage device of claim 16, wherein:

the emergency detected at the property is detected by a server associated with a monitoring system located in the property; and the set of unlock instructions is remotely generated by the server;

enabling transmission of the particular unlock instruction to the electronic lock comprises transmitting, by the server, the particular unlock instruction to a control unit of the monitoring system.

* * * * *